US006093999A

United States Patent [19]

English et al.

[11] Patent Number: 6,093,999

[45] Date of Patent: Jul. 25, 2000

[54] VEHICLE LAMP WITH SHAPED ENVELOPE INTERIOR PROVIDING A LIGHT-TRAPPING DOME

[75] Inventors: George J. English, Reading, Mass.; Michael D. Tucker, Henniker, N.H.

[73] Assignee: Osram Sylvania Inc., Danvers, Mass.

[21] Appl. No.: 09/054,683

[22] Filed: Apr. 3, 1998

Related U.S. Application Data

[60] Provisional application No. 60/045,017, Apr. 28, 1997.

[51] Int. Cl.[7] ..... H01J 5/16

[52] U.S. Cl. ..... 313/110; 313/635; 313/634; 362/211

[58] Field of Search ..... 313/110, 113, 313/567, 568, 569, 572, 573, 578, 579, 620, 634, 635

[56] References Cited

U.S. PATENT DOCUMENTS

| | | | |
|---|---|---|---|
| 4,412,273 | 10/1983 | Helbig et al. | 362/211 |
| 4,622,486 | 11/1986 | Endo | 313/115 |
| 4,623,958 | 11/1986 | Van Der Lind et al. | 362/267 |
| 4,751,421 | 6/1988 | Braun et al. | 313/318 |
| 4,812,703 | 3/1989 | Kanematsu et al. | 313/318 |
| 5,313,135 | 5/1994 | Fletcher | 313/318 |
| 5,734,227 | 3/1998 | Gotoh . | |

FOREIGN PATENT DOCUMENTS

| | | |
|---|---|---|
| 0 187 507 | 7/1986 | European Pat. Off. . |
| 8601283 U | of 0000 | Germany . |
| 06310108 | 11/1994 | Japan . |
| 08306343 | 11/1996 | Japan . |
| 966793 | 10/1982 | U.S.S.R. . |

*Primary Examiner*—Nimeshkumar D. Patel
*Assistant Examiner*—Matthew J Gerike
*Attorney, Agent, or Firm*—William E. Meyer

[57] ABSTRACT

A lamp capsule includes a lamp envelope having a tubular portion and a dome closing one end of the tubular portion, a light source mounted in the lamp envelope on or near its central axis for emitting light when energized by electrical energy and a light attenuating coating over the dome. The dome has a shape that traps light emitted by the light source in the direction of the dome. The dome may be shaped such that a dome angle between a tangent to the interior surface of the dome and the central axis of the lamp envelope is 45° or less. The dome may be shaped as a hyperbolic surface of revolution. The lamp capsule is typically used in a vehicle headlamp and provides low glare.

25 Claims, 6 Drawing Sheets

VEHICLE LAMP WITH SHAPED ENVELOPE INTERIOR PROVIDING A LIGHT-TRAPPING DOME

CROSS REFERENCE TO RELATED APPLICATION

This application claims the benefit of provisional application Ser. No. 60/045,017 filed Apr. 28, 1997.

FIELD OF THE INVENTION

This invention relates to lamp capsules for vehicle headlamps and, more particularly, to lamp capsules which produce low glare in vehicle headlamp applications.

BACKGROUND OF THE INVENTION

Vehicle headlamps commonly include a lamp capsule mounted in a reflector so that the light source is located at or near the focal point of the reflector. Light emitted by the lamp capsule is directed in a forward direction by the reflector. The lamp capsule typically includes a high beam filament from which light is directed horizontally in a high beam pattern and a low beam filament from which light is directed below horizontal in a low beam pattern. One of the problems involved in the design and construction of vehicle headlamps is to minimize uncontrolled light emission outside the beam patterns, particularly the low beam pattern, that may impair the ability of oncoming drivers to see the road and other vehicles. This uncontrolled light is known as glare.

The lamp envelopes of lamp capsules used in vehicle headlamps are commonly formed from tubes that are domed, or tipped off, at the forward end and are press sealed at the rear end. The lamp capsule is aligned in a headlamp reflector so that the domed portion faces forward and the axis of the lamp envelope is colinear with the optical axis of the reflector. Light emitted from the light source within the lamp envelope projecting directly forward encounters the domed portion. Due to the irregular shaping of the dome, this light is refracted at odd angles and becomes a hot spot or glare source. To control the irregular light emission, the dome of the lamp envelope is commonly dipped in a black paint to block light from exiting the lamp in the domed portion of the lamp envelope. An example of a prior art vehicle lamp capsule having a press seal and a dome with a radiation-absorbing coating is disclosed in U.S. Pat. No. 4,794,297, issued Dec. 27, 1988 to Gaugel et al.

It had been believed by workers in the field that the black paint absorbed most of the light, thereby solving the glare problem. However, it has been found that a noticeable portion of the light expected to be absorbed in the dome may be reflected back into the lamp, striking the light source, the support structures and the press seal. This reflected light is then reflected out of the lamp, where it remains uncontrolled and produces glare. Accordingly, there is a need to control the light projected into the dome of a vehicle lamp capsule.

SUMMARY OF THE INVENTION

According to a first aspect of the invention, a lamp capsule is provided. The lamp capsule comprises a lamp envelope having a tubular portion and a dome closing one end of the tubular portion, a light source mounted in the lamp envelope on or near its central axis for emitting light when energized by electrical energy, connection means for supplying electrical energy to the light source and a light-attenuating coating over the dome. The dome has a shape that substantially traps light emitted by the light source in the direction of the dome. The light source is typically a filament.

The dome may be shaped such that a dome angle between a tangent to the interior surface of a dome and the central axis of the lamp envelope is 45° or less. In one embodiment, the interior surface of the dome comprises a hyperbolic surface of revolution. In another embodiment, the interior surface of the dome comprises a conical surface. The interior surface of the dome may comprise a light-trapping horn.

According to another aspect of the invention, a vehicle headlamp is provided. The vehicle headlamp comprises a reflector having a focal point, a lamp capsule and a lamp connector for mounting the lamp capsule in the reflector. The lamp capsule comprises a lamp envelope having a tubular portion and a dome closing one end of the tubular portion. The dome is shaped such that a dome angle between a tangent to the interior surface of the dome and the central axis of the lamp envelope is 45° or less. The lamp capsule further comprises a light source mounted in the lamp envelope for emitting light when energized by electrical energy and a light-attenuating coating over the dome.

According to a further aspect of the invention, a lamp envelope for a vehicle headlamp is provided. The lamp envelope comprises a light-transmissive body having a tubular portion and a dome closing one end of the tubular portion. The dome is shaped such that a dome angle between a tangent to an interior surface of the dome and the central axis of the lamp envelope is 45° or less. The lamp envelope further comprises a light-attenuating layer on the dome.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
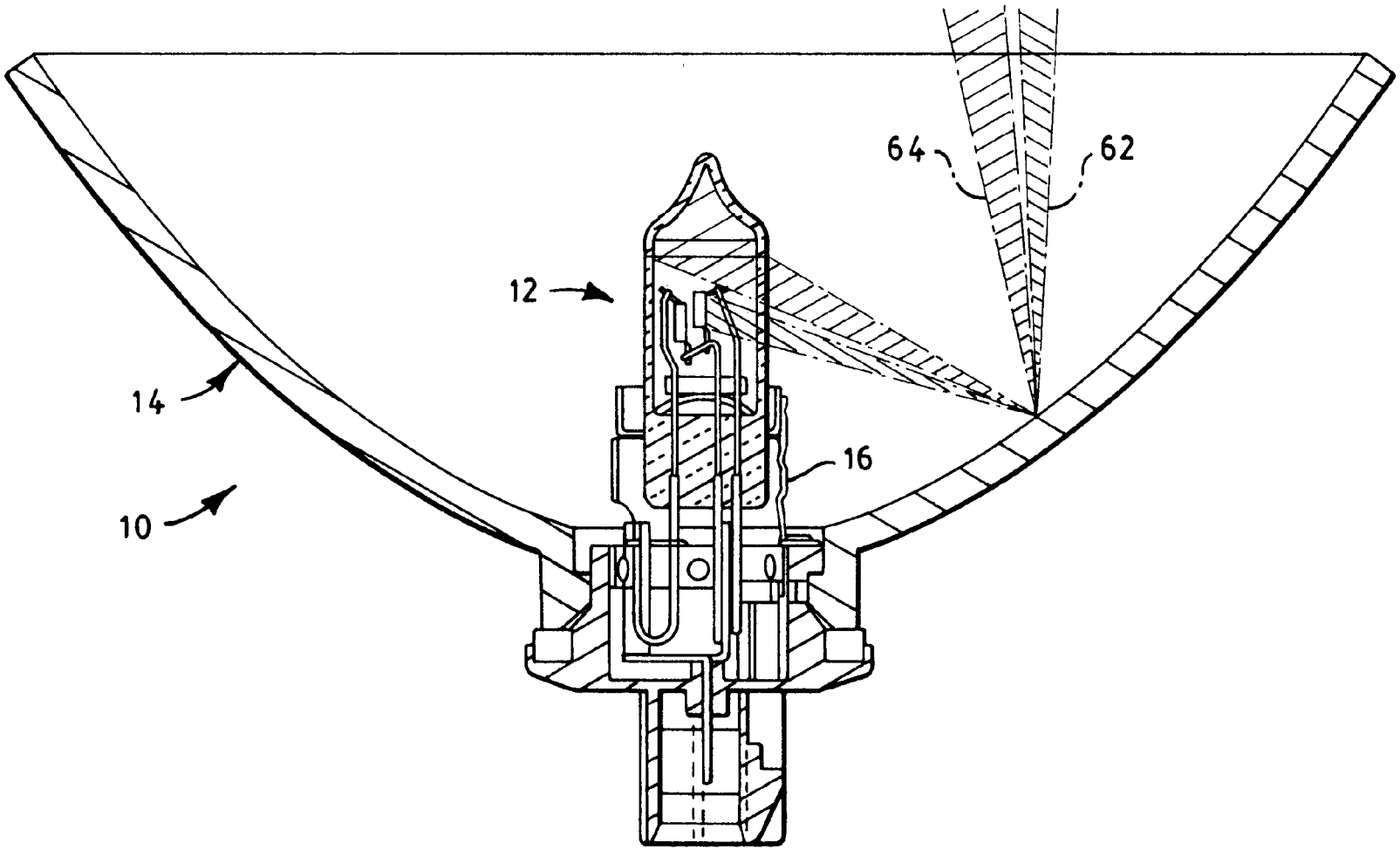
FIG. 1 is a cross-sectional side view of a vehicle headlamp assembly in accordance with the invention.
Figure 2:
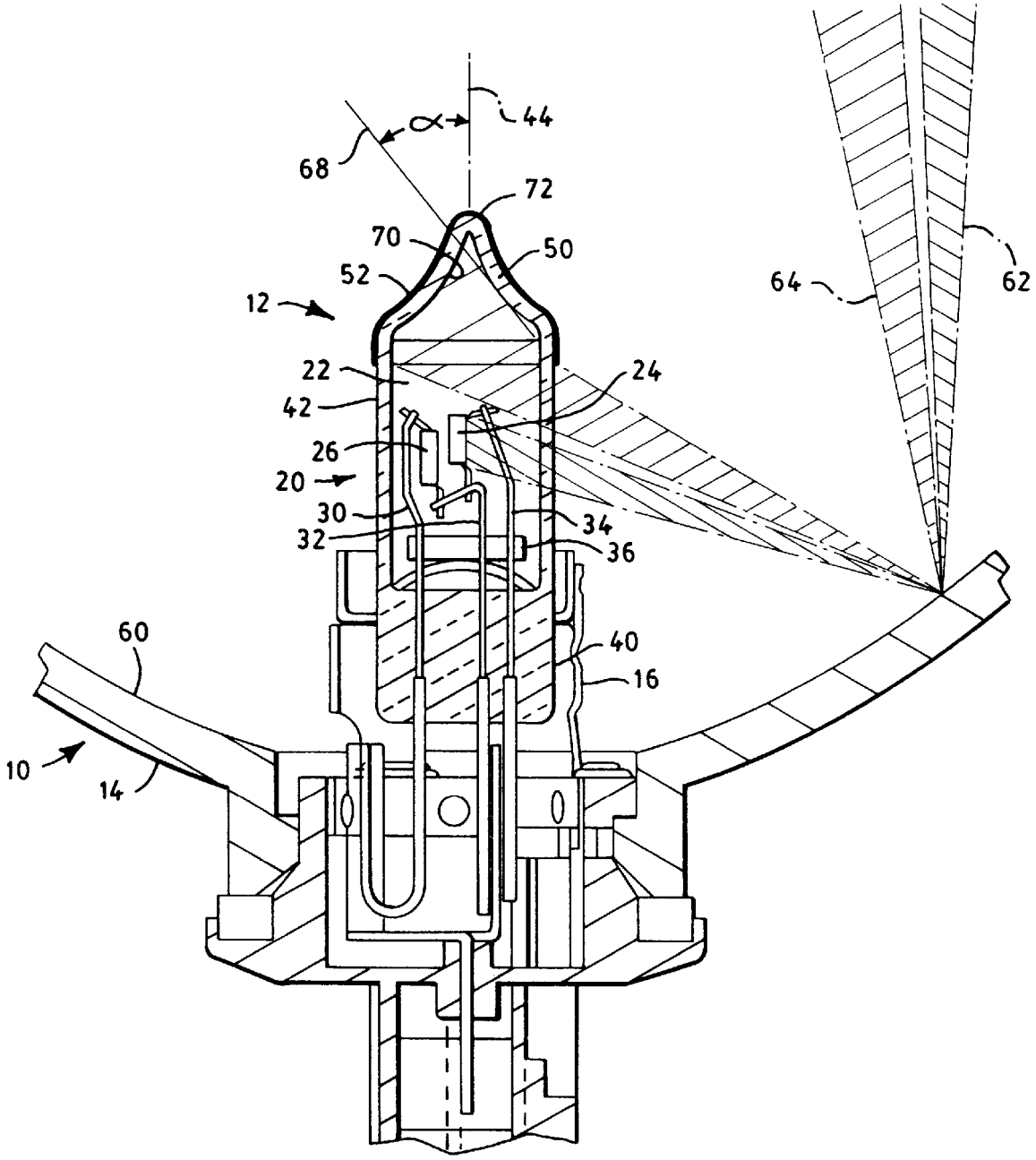
FIG. 2 is an enlarged, partial cross-sectional view of the headlamp assembly, showing the lamp capsule.

An example of a vehicle headlamp in accordance with the invention is shown in FIGS. 1 and 2. Like elements in FIGS. 1 and 2 have the same reference numerals. A vehicle headlamp 10 includes a lamp capsule 12 mounted within a reflector 14. A lamp connector 16 mechanically mounts lamp capsule 12 in reflector 14 and supplies electrical energy to lamp capsule 12. The open side of reflector 14 is closed by a light-transmissive cover or lens (not shown).

Lamp capsule 12 includes a lamp envelope 20 of a light-transmissive material, such as glass, which defines an enclosed volume 22. A low beam filament 24 and a high beam filament 26 are mounted within lamp envelope 20.

Wires 30, 32 and 34 provide mechanical support for filaments 24 and 26 and supply electrical energy to filaments 24 and 26, as known in the art. A lead frame 36 provides mechanical support for wires 30, 32 and 34 and filaments 24 and 26. Wires 30, 32 and 34 pass through a press seal 40 of lamp envelope 20 and contact conductors in lamp connector 16.

Lamp envelope 20 includes a generally tubular portion 42 having a central axis 44. The tubular portion 42 is closed at one end by a tip off portion, or dome 50, and is closed at the other end by press seal 40. As described in detail below, dome 50 is shaped to trap light emitted by filaments 24 and 26 in the direction of dome 50 and to thereby reduce glare associated with the headlamp. A light-attenuating layer 52, such as black paint, covers the outside surface of dome 50 and prevents transmission of light through dome 50.

The reflector 14 has a reflecting surface 60 that is typically a parabolic surface of revolution about an optical axis of the reflector. The lamp capsule 12 is positioned by connector 16 such that filaments 24 and 26 are located at or near the focal point of the parabolic reflecting surface and the central axis 44 of lamp envelope 20 is colinear with the optical axis of reflector 14. Light emitted, for example, by filament 24 is reflected by reflecting surface 60 in a forward direction through an open side of reflector 14, as indicated by rays 62. Light emitted by filament 24 and reflected by reflecting surface 60 is directed parallel to the optical axis of reflector 14 and produces a desired beam pattern. However, light originating from portions of lamp capsule 12 other than filaments 24 and 26, such as reflections from various lamp components, is directed by reflecting surface 60 in a direction that is not parallel to the optical axis of reflector 14 and results in uncontrolled glare. Such uncontrolled glare is represented in FIGS. 1 and 2 by rays 64.

In accordance with an important aspect of the invention, dome 50 is shaped so as to trap a substantial portion of the light emitted by filaments 24 and 26 in the direction of dome 50. Because this light is trapped by dome 50 rather than being reflected back to other portions of the lamp capsule 12, uncontrolled glare is substantially reduced. In general, dome 50 is shaped as a light-trapping horn which causes incident light to undergo multiple light loss reflections within dome 50 rather than being reflected out of dome 50.

A dome angle a may be defined as the angle between the central axis 44 of the lamp capsule 12 and a tangent 68 to an interior surface 70 of dome 50. When the dome angle $\alpha$ is 45°, light should be reflected twice (once from each side) to come approximately straight back, assuming an infinitely distant light source. When the light source is closer to dome 50, the dome angle must be smaller to obtain two or more reflections. For a fixed dome angle, the angle of reflection in a region near tip 72 may be low enough to trap most of the entering light with two or more reflections and absorptions. By making the dome angle smaller, or positioning the light source farther away from the dome, the region of the dome that is light-trapping becomes larger. Ideally, all of the dome should be light-trapping with regard to all of the filament. Practically, the largest reflection angle is between the upper part of the filament and the lower part of the dome. The preferred largest dome angle is therefore 45° or less. Since the interior surface of lamp envelope 20 goes through a smooth transition from the dome 50 to tubular portion 42, some portion of the dome surface near this transition has a dome angle larger than 45°. By making the dome angle 30° or less, light extending parallel to the axis 44 is reflected from one side of the dome to the opposite side of the dome. By making the dome angle even smaller, even more reflections and absorptions occur.

One suitable lamp shape uses a relatively large dome angle near the tubular portion 42, for example 45° or less. Higher in the dome and closer to the axis 44, the interior wall of the dome has a progressively smaller angle with respect to the axis. For example, a monotonic curve forming a surface of revolution about axis 44 may be used. A hyperbolic curve is suitable.

Figure 3:
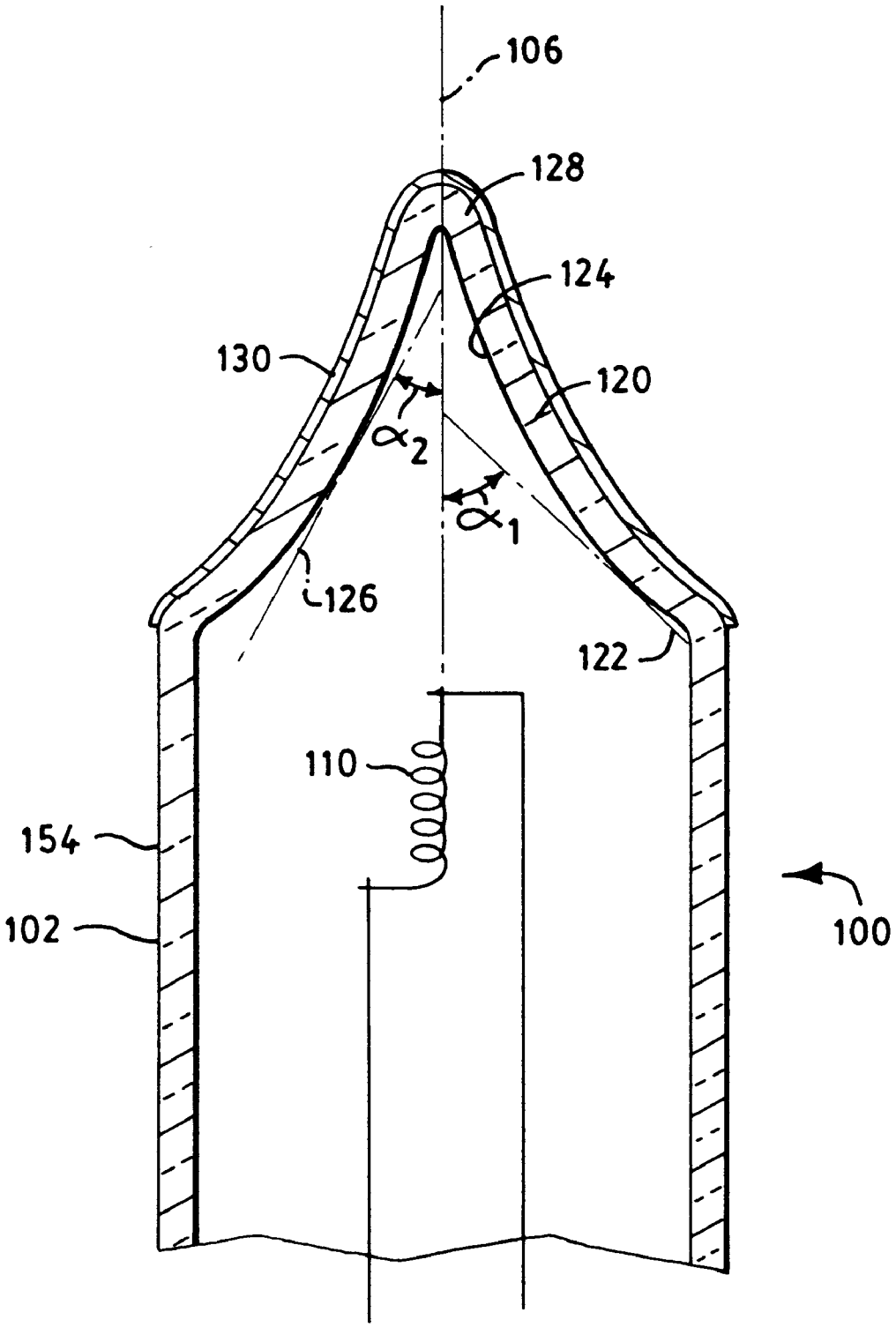
FIG. 3 is a schematic, partial cross-sectional view of an embodiment of the lamp capsule of the present invention.

A partial schematic view of a lamp capsule 100 having a dome with a hyperbolic shape is shown in FIG. 3. A lamp envelope 102 includes a tubular portion 104 having a central axis 106. A filament 110 is mounted within lamp envelope 102. A dome 120 is shaped as a hyperbolic surface of revolution about axis 106. A light-attenuating layer 130 covers dome 120. A dome angle $\alpha_1$ between a tangent 122 to interior surface 124 of dome 120 near tubular portion 104 is relatively large (but 45° or less), and a dome angle $\alpha_2$ between a tangent 126 to interior surface 124 near tip 128 is relatively small. It will be understood that the shape of dome 120 does not require mathematical precision. In this embodiment, an approximation to a hyperbolic curve reduces glare substantially.

Figure 4:
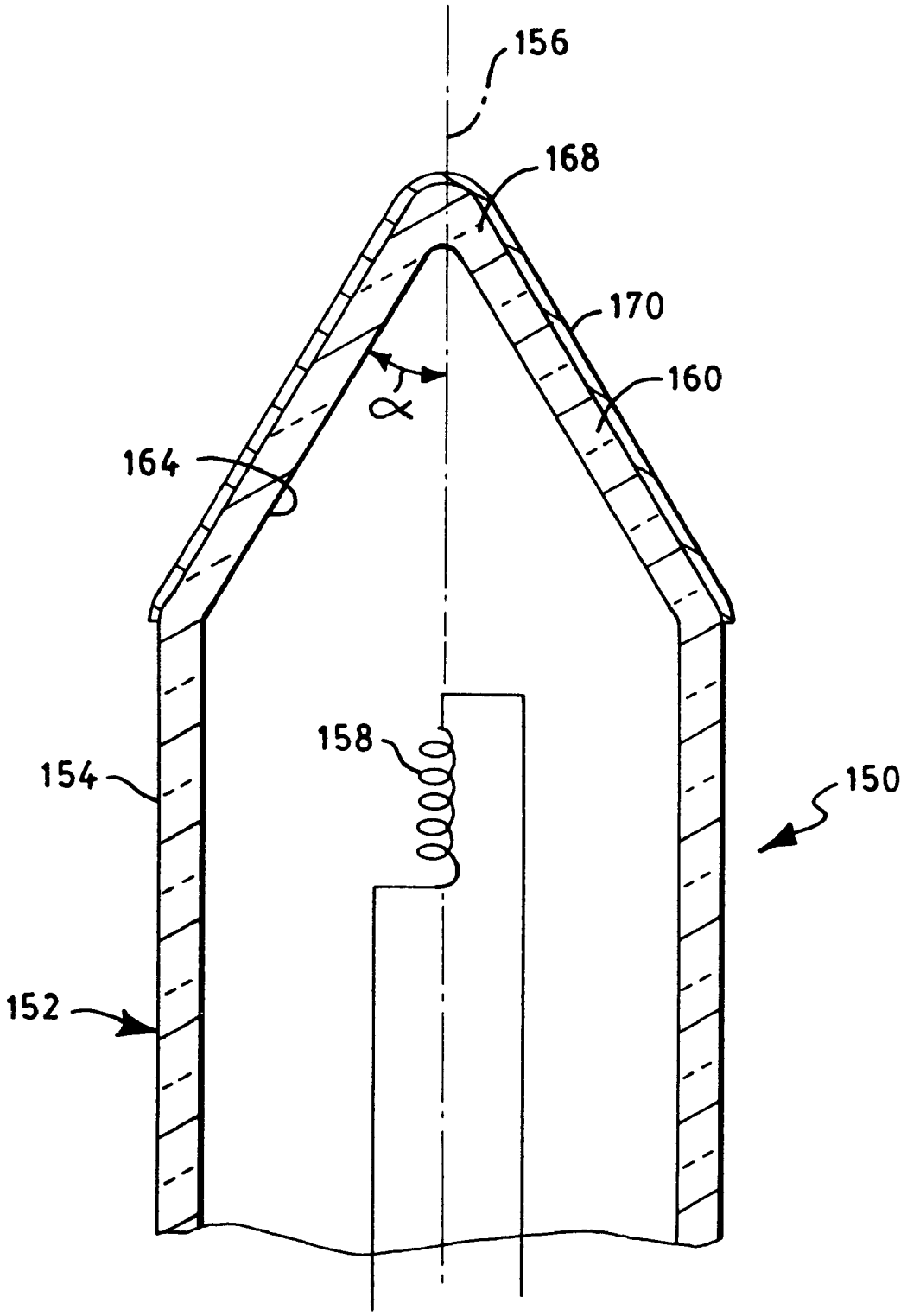
FIG. 4 is a schematic, partial cross-sectional view of another embodiment of the lamp capsule of the present invention.

A partial schematic view of a lamp capsule 150 having a dome with a conical shape is shown in FIG. 4. The lamp envelope 152 includes a tubular portion 154 having a central axis 156. A filament 158 is mounted within lamp envelope 152. A dome 160 closes one end of tubular portion 154 and has a conical or nearly conical shape. A light-attenuating layer 170 covers dome 160. A dome angle $\alpha$ between central axis 156 and a tangent to interior surface 164 of dome 160 is substantially constant between tubular portion 154 and tip 168. Again, it will be understood that the dome shape is not required to have mathematical precision, and some deviation in the dome angle and in the conical shape is acceptable within the scope of the invention. The general requirement is to provide a dome angle of 45° or less, so that light is trapped within dome 160.

Figure 5:
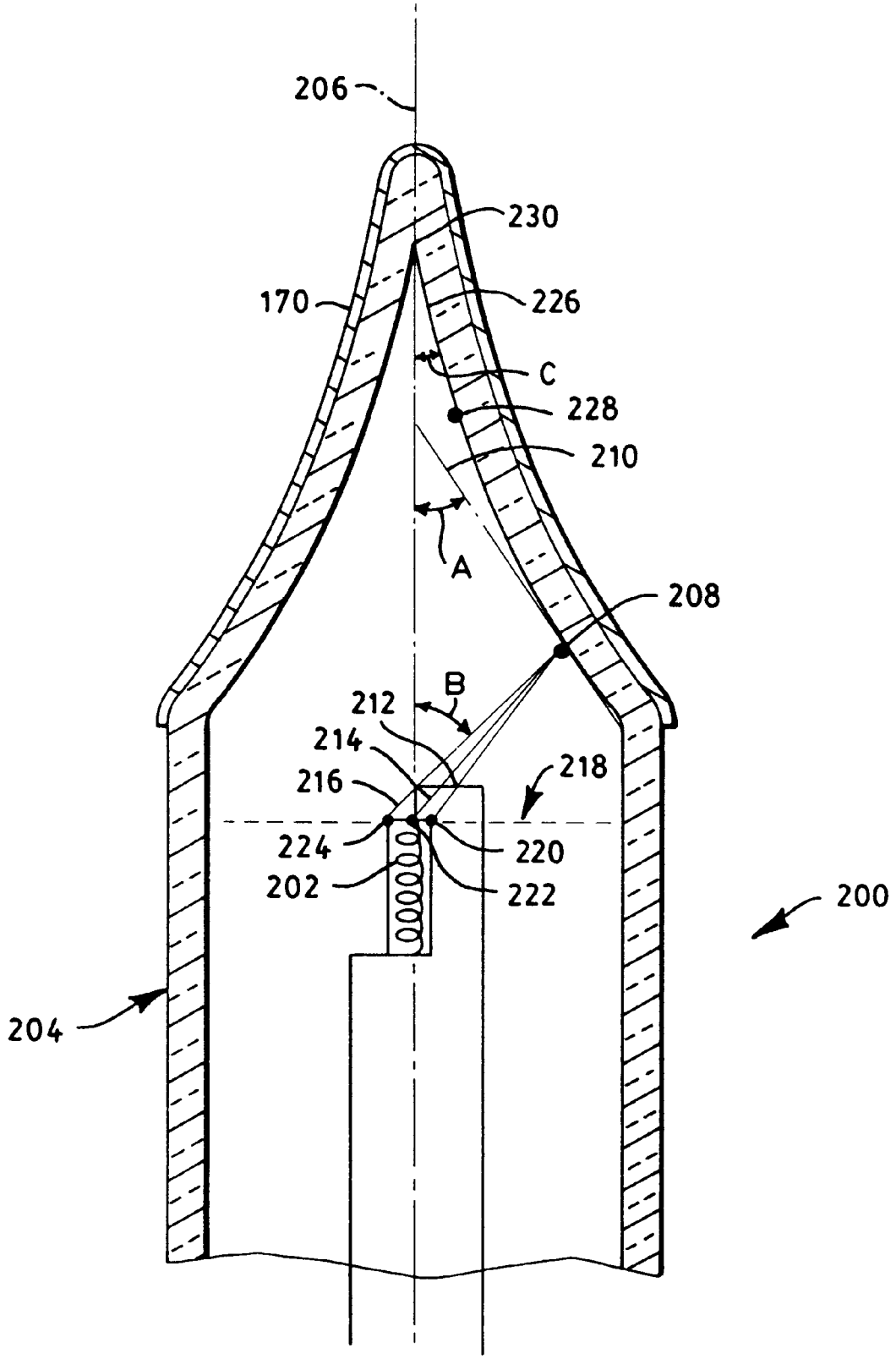
FIG. 5 is a schematic, partial cross-sectional view of still another embodiment of the lamp capsule of the present invention.

A partial schematic view of a lamp capsule 200 having a dome with a horn shape is shown in FIG. 5. The light source 202 is mounted in the tubular portion 204 of the lamp envelope on or near said central axis 206. The dome has a point 208 with a tangent 210 in the plane of the central axis 206 and the dome point 208 that forms and angle A with the central axis 206. A line (212, 214, or 216) can be drawn from the dome point 208 to a nearby point on the filament 202 in an end plane 218 perpendicular to the central axis 206 on the filament end closest to the dome. The chosen point may be, for example, the nearest filament point 220, or the intersection point between the plane and the central axis 222, or the point 224 giving the largest axial angle to the dome point 208. The dome portion 208 is shaped such that for substantially all dome points 208, the angle A of the tangent 210 to the dome at a dome point 208, the tangent 210 being in the plane containing the central axis 206 and the dome point 208, is less than the (90−B)/2, where B is the angle from the central axis 206 to a line (212, 214, or 216) between the dome point and a filament point (220, 222, or 224) located in the end plane 218. The dome may be shaped in one case for when the filament point is the point 220 of the filament closest to the dome point. This accommodates the nearest light source point, and substantially captures most of the light in the dome, and requires a less steep, and less deep of a horn shape. The dome may also be shaped for the case when the filament point is the intersection point 222 of the central axis 206 and the plane 218 of the nearby filament end. (This point may not be actually on the filament.) The intersection point 222 is easy to identify for design work, and is a fair average of the available choices. A somewhat steeper and deeper horn shaped dome results. In a further case, the filament point 224 giving the largest axial angle to the dome point 208 may be chosen. Optically, this gives better overall results, but requires a still steeper and deeper dome shape. The lamp capsule may be further shaped such that a first angle C between the central axis 206 and a first tangent 226 (co-planar with the central axis) to a first dome point 228 is less than a second angle A between the central axis 206 and a second tangent 210 (also co-planar with the central axis) to a second dome point 208, where the second dome point 208 is closer in the axial direction to the filament 202 than is the first dome point 228 for substantially each pair of dome points 228, 208. The dome then has a progressively smaller axial angle as the tip end 230 is approached.

The light-trapping dome as described above may be fabricated by roller forming. A glass tube is placed in a glass lathe, and the region of the dome is heated. A roller having the desired shape (such as hyperbolic or conical) contacts the heated tube and forms it to the desired shape. In another approach, the glass tube is heated in the dome region and is pulled axially to form the desired shape.

Figure 6:
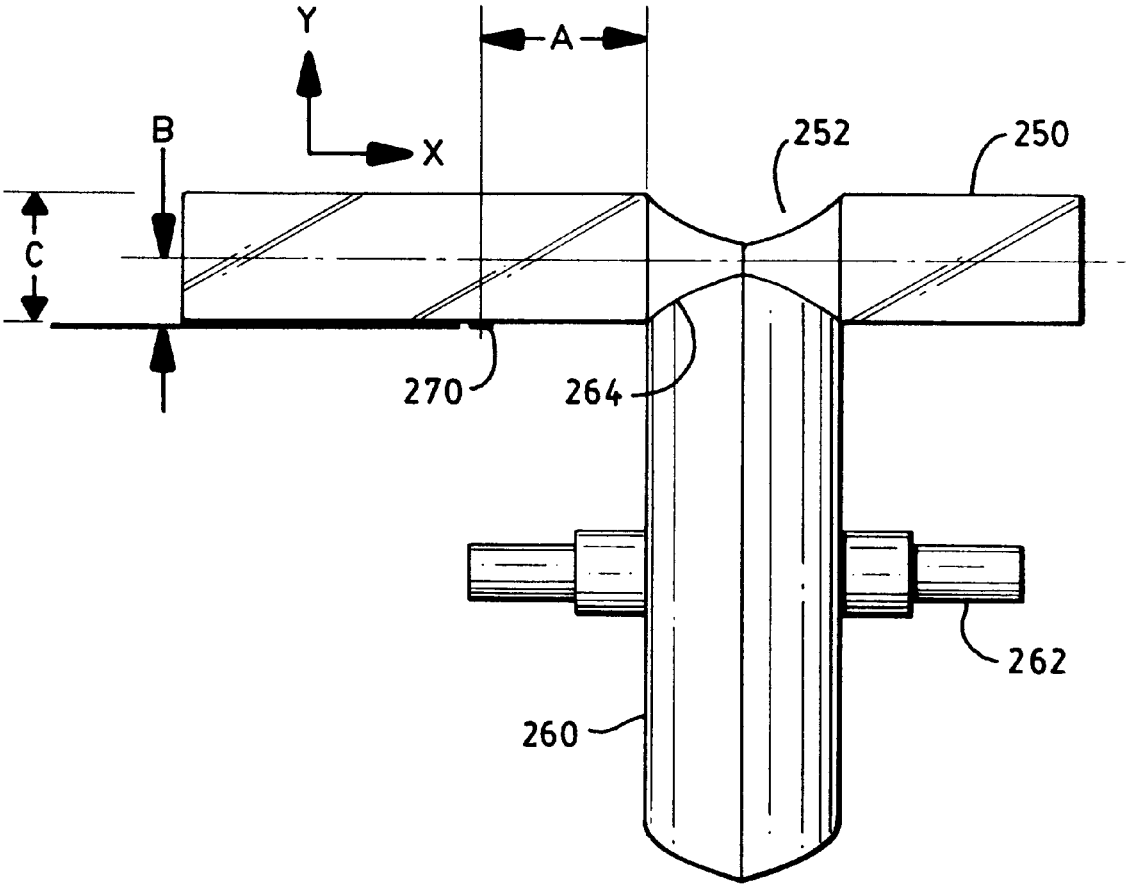
FIG. 6 is a schematic illustration of an example of a technique for forming a lamp envelope having a light-trapping dome.

FIG. 6 is an illustration of roller forming of the light-trapping dome. A glass tube 250 is heated in a region 252 and is mounted in a glass lathe (not shown). A roller 260 is mounted for rotation on a shaft 262. A surface 264 of roller 260 has the desired shape, such as for example, hyperbolic, of the light-trapping dome. Roller 260 is placed in contact with heated region 262 of glass tube 260, and both are rotated to form the light-trapping dome.

In one example of the light-trapping dome, a hyperbolic shape according to the following equation is utilized.

$$\frac{X^2}{(.21)^2} - \frac{Y^2}{(.76)^2} = 1$$

The X and Y directions are indicated in FIG. 6, and the origin of the coordinate system is at point 270. In the example of FIG. 6, dimension A may be 0.76", dimension B may be 0.31" and dimension C may be 0.58". As indicated above, a variety of different shapes of the light-trapping dome may be utilized within the scope of the present invention.

Lamp capsules having lamp envelopes with hyperbolic dome shapes in accordance with the invention have exhibited a reduction in uncontrolled light emission of 25% to 30% as compared with prior art lamp capsules.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A lamp capsule comprising:

a lamp envelope including a tubular portion and a dome closing one end of said tubular portion, said lamp envelope having a central axis;

a light source mounted in said lamp envelope on or near said central axis for emitting light when energized by electrical energy, said dome having a shape that substantially traps light emitted by said light source in the direction of said dome;

connection means for supplying electrical energy to said light source; and a light-attenuating layer on said dome.

2. A lamp capsule as defined in claim 1 wherein said dome is shaped such that a dome angle between a tangent to an interior surface of said dome and the central axis of said lamp envelope is 45° or less.

3. A lamp capsule as defined in claim 1 wherein an interior surface of said dome comprises a hyperbolic surface of revolution.

4. A lamp capsule comprising:

a lamp envelope including a tubular portion and a dome closing one end of said tubular portion, said lamp envelope having a central axis;

a light source mounted in said lamp envelope on or near said central axis for emitting light when energized by electrical energy, said dome having a shape that substantially traps light emitted by said light source in the direction of said dome;

connection means for supplying electrical energy to said light source; and a light-attenuating layer on said dome;

wherein an interior surface of said dome comprises a conical surface.

5. A lamp capsule as defined in claim 1 wherein an interior surface of said dome comprises a light-trapping horn.

6. A lamp capsule as defined in claim 1 wherein said light source comprises a filament.

7. A lamp capsule as defined in claim 6 wherein an interior surface of said dome comprises a light-trapping horn.

8. A vehicle headlamp comprising:

a reflector having a focal point;

a lamp capsule comprising a lamp envelope including a tubular portion and a dome closing one end of said tubular portion, said lamp envelope having a central axis, wherein said dome is shaped such that a dome angle between a tangent to an interior surface of said dome and the central axis of said lamp envelope is 45° or less, a light source mounted in said lamp envelope for emitting light when energized by electrical energy, and a light-attenuating layer on said dome; and a lamp connector for mounting said lamp capsule in said reflector with said light source positioned at or near said focal point and for supplying electrical energy to said lamp capsule.

9. A lamp capsule comprising:

a lamp envelope including a tubular portion and a dome closing one end of said tubular portion, said lamp envelope having a central axis;

a light source mounted in said lamp envelope on or near said central axis for emitting light when energized by electrical energy, said dome having a shape that substantially traps light emitted by said light source in the direction of said dome;

connection means for supplying electrical energy to said light source; and a light-attenuating layer on said dome;

wherein said light source comprises a filament;

wherein an interior surface of said dome comprises a light-trapping horn; and wherein an interior surface of said dome comprises a conical shape.

10. A vehicle headlamp as defined in claim 8 wherein an interior surface of said dome comprises a hyperbolic surface of revolution.

11. A vehicle headlamp as defined in claim 8 wherein an interior surface of said dome comprises a light-trapping horn.

12. A vehicle headlamp as defined in claim 8 wherein said dome angle is 30° or less.

13. A vehicle headlamp as defined in claim 8 wherein said dome angle is relatively large near an intersection of said dome with said tubular portion and is relatively small near a tip thereof.

14. A vehicle headlamp as defined in claim 8 wherein said light source comprises a filament.

15. A lamp capsule comprising:

a lamp envelope including a tubular portion and a dome closing one end of said tubular portion, said lamp envelope having a central axis, wherein said dome is shaped such that a dome angle between a tangent to an interior surface of said dome and the central axis of said lamp envelope is 45° or less;

a light source mounted in said lamp envelope for emitting light when energized by electrical energy;

connection means for supplying electrical energy to said light source; and a light-attenuating layer on said dome.

16. A lamp capsule as defined in claim 15 wherein an interior surface of said dome comprises a hyperbolic surface of revolution.

17. A lamp capsule comprising:

a lamp envelope including a tubular portion and a dome closing one end of said tubular portion, said lamp envelope having a central axis, wherein said dome is shaped such that a dome angle between a tangent to an interior surface of said dome and the central axis of said lamp envelope is 45° or less;

a light source mounted in said lamp envelope for emitting light when energized by electrical energy;

connection means for supplying electrical energy to said light source; and a light-attenuating layer on said dome wherein an interior surface of said dome comprises a conical surface.

18. A lamp capsule as defined in claim 15 wherein said dome angle is 30° or less.

19. A lamp capsule as defined in claim 15 wherein said dome angle is relatively large near an intersection of said dome with said tubular portion and is relatively small near a tip thereof.

20. A lamp envelope for a vehicle headlamp, comprising:

a light-transmissive body including a tubular portion and a dome closing one end of said tubular portion, said lamp envelope having a central axis, said dome being shaped such that a dome angle between a tangent to an interior surface of said dome and the central axis of said lamp envelope is 45° or less; and a light-attenuating layer on said dome.

21. A lamp capsule comprising:

a lamp envelope including a tubular portion and a dome closing one end of said tubular portion, said lamp envelope having a central axis;

a light source mounted in said tubular portion of said lamp envelope on or near said central axis, for emitting light when energized by electrical energy, said dome having a shape such that for substantially all dome points, the angle of a tangent to the dome at such a dome point, said tangent being in the plane containing the dome point and the central axis, has an angle A to the central axis such that angle A is less than the (90−B)/2, where B is the angle from the axis to a line between the dome point and a filament point located in a plane perpendicular to the central axis, said plane otherwise being closest to the dome;

an electrical connection for supplying electrical energy to said light source; and a light-attenuating layer on said dome.

22. The lamp capsule in claim 21, wherein the dome is further shaped such that the filament point is the point of the filament closest to the dome point.

23. The lamp capsule in claim 21, wherein the dome is further shaped such that the filament point is a point on the central axis.

24. The lamp capsule in claim 21, wherein the dome is further shaped such that the filament point is a point on the filament with the largest axial angle with respect to the dome point.

25. The lamp capsule in claim 21, wherein the dome is further shaped such that a first angle between the central axis and a first tangent (co-planar with the central axis) to a first dome point is less than a second angle between the central axis and a second tangent (also co-planar with the central axis) to a second dome point, where the second dome point is closer in the axial direction to the filament for substantially each pair of dome points.

* * * * *